US005771793A

United States Patent [19]

Kayser

[11] Patent Number: 5,771,793

[45] Date of Patent: Jun. 30, 1998

[54] CALENDER HAVING A CONTROL DEVICE

[75] Inventor: Franz Kayser, Geldern, Germany

[73] Assignee: Voith Sulzer Finishing GmbH, Krefeld, Germany

[21] Appl. No.: 651,262

[22] Filed: May 22, 1996

[30] Foreign Application Priority Data

May 24, 1995 [DE] Germany ..... 195 19 011.4

[51] Int. Cl.[6] ..... D21G 1/02

[52] U.S. Cl. ..... 100/47; 100/73; 100/76; 100/86; 100/95; 100/161; 242/525.1

[58] Field of Search ..... 100/38–40, 47, 100/73–76, 86, 92, 93 R, 93 RP, 94, 161–167, 95; 83/495–507; 242/525.1

[56] References Cited

U.S. PATENT DOCUMENTS

| | | | |
|---|---|---|---|
| 1,925,866 | 9/1933 | Drake | 100/76 |
| 4,480,537 | 11/1984 | Agronin et al. | 100/38 |
| 4,642,164 | 2/1987 | Hanikoski et al. | 100/38 |

FOREIGN PATENT DOCUMENTS

| | | | |
|---|---|---|---|
| Ad.30984 | 10/1926 | France | 100/162 R |
| 2 628 768 | 9/1989 | France . | |
| 2 147 912 | 11/1972 | Germany . | |
| 25 55 677 | 6/1977 | Germany . | |
| 59-83840 | 6/1984 | Japan . | |
| 61-116656 | 7/1985 | Japan . | |
| 63-113037 | 7/1988 | Japan . | |
| 1-58698 | 4/1989 | Japan . | |
| 2-35079 | 8/1990 | Japan . | |
| 3-128697 | 12/1991 | Japan . | |
| 6-330495 | 11/1994 | Japan . | |
| 8-246383 | 9/1996 | Japan . | |
| 604 940 | 9/1978 | Switzerland . | |
| 202753 | 8/1923 | United Kingdom | 100/162 R |

OTHER PUBLICATIONS

Rollenschneid–Fund Wickelmaschinen Antriebstechnische Eroterungen, "Papiervervarbeiter," vol. 9 (1967).

Die Escher Wyss Nipco–Walze Und Deren Anwendung In Der Papierindustrie, R. Lehmann, "Wochenblatt für Papierfabrikation," 22 (1973), pp. 871 through 874.

Inline–Konfektionierung, "VNI", vol. 2 (1986), p. 53.

"Die neuen Superkalanderkonzepte", Voith Sulzer Papiertechnik, 1994, No. May 1994 d.

*Primary Examiner*—Stephen F. Gerrity
*Attorney, Agent, or Firm*—Darby & Darby

[57] ABSTRACT

A calender for treating a web of material includes at least two rollers forming a roller nip therebetween. A take-up device is disposed downstream from the at least two rollers. At least one longitudinal cutter is disposed between the at least two rollers and the take-up device. The at least one longitudinal cutter divides the web of material into at least two partial webs. The take-up device has at least two winding stations. Each of the winding stations corresponds to one of the partial webs.

23 Claims, 2 Drawing Sheets

CALENDER HAVING A CONTROL DEVICE

BACKGROUND OF THE INVENTION

1. Field of the Invention

The present invention relates to a calender for treating a web of material. In particular, the present invention relates to a calender having at least two rollers, which form a roller nip therebetween, and a take-up device disposed downstream of the rollers.

2. Discussion of the Related Art

Calenders are known, for example, from the brochure "The New Supercalender Designs" (1994) from the firm of Sulzer Papertec. After being treated by the calender, the web of material is formed into a roll in the take-up device. The axial length of the roll corresponds to the width of the web. In a calender, it is preferable to treat a web of material that has a relatively large width. However, for long rolls (i.e., those rolls having a relatively large axial length), it is very difficult to wind the roll in the take-up device uniformly. There have been numerous attempts to provide the take-up device with supplementary devices to improve the winding results.

While it is preferred to work with greater web widths when treating a web of material, in actual practice, for example, in a printing plant, substantially smaller web widths are needed. Therefore, separate web slitting machines are used. These web slitting machines, with the aid of longitudinal cutters, divide the relatively wide web into individual partial webs. In a winding station, each of these individual partial webs are wound onto a separate winding tube, which has a relatively smaller axial length.

SUMMARY OF THE INVENTION

The present invention is directed to a calender which comprises a longitudinal cutter disposed between the last roller nip and the take-up device to divide the web of material into at least two partial webs. The take-up device includes at least two winding stations, one for each partial web.

The wide roll that was previously wound on the calender take-up device is, according to the present invention, replaced by several narrower rolls. The reduction in width alone brings about significant improvements in the quality of the winding, due to the fact that, as a rule, differences in the parameters that affect the quality of the rolls are smaller with narrower rolls than they are with wider rolls. Additionally, the weight of the roll is lower and, as a result of the shorter axle, the flexing of the roll is reduced.

The web of material is loaded significantly less heavily because one take-up procedure is eliminated at the exit from the calender, as is one take-off procedure at the entry into the web slitting machine. As a result, the web material can be stressed more heavily in the calender according to the present invention.

As a result of the elimination of a separate web slitting machine, lower production costs and reduced space requirements are achieved. In addition, transport of the web material from the calender to the web slitting machine is also dispensed with, which permits savings in terms of personnel. Paper waste, which results from the drawing of webs of paper through any given machine, is reduced by about half. In conventional slitting machines it is necessary to make up for delays that occur as a result of the discontinuity of the slitting process by increasing the speeds of the slitting machine and the take-up device. However, because the present invention dispenses with the use of a separate slitting machine, the slitting and take-up speeds can be reduced. Therefore, the service lifetimes of the take-up machine and the slitting blades can be increased.

One preferred embodiment of the present invention includes, in each of the winding stations, a drive device. A control device regulates the drive device to maintain the circumferential speed of the partial-web rolls at approximately the same speed as the web within the calender. The control device also carries out individual corrections of the circumferential speed to further improve the winding results. The individual corrections of the circumferential speed are preferably dependent on the properties of the partial-web rolls. The take-up procedure is thus partly dependent on the data received from the calender, and partly on the data received from the individual windings.

A control device for the calender functions preferably operates in a zone-by-zone manner. The control device regulates calender functions, such as the compressive stress in the roller nip, the dwell time in the web of material in the roller nip, the temperature of the web of material and/or the moisture of the web of material. The proper control of these functions provide the desired finished treated properties of the web of material, such as smoothness or gloss. The control device controls the operations of the calender in accordance with the parameters of the finished web, the partial webs and/or the partial-web rolls. The calender system has a large number of options for affecting the web that is to be treated. In this regard, one can obtain the same characteristic by means of controlling different combinations of the calender functions. For example, a lower compressive stress in the roller nip can be replaced by a higher temperature to achieve substantially the same characteristic in the treated web. It is therefore possible to introduce an additional dependency, which provides for a higher uniformity in the winding.

Measuring devices are preferably provided for detecting the partial-web roll diameter and/or the tensile stresses of the partial webs. These measured properties are used as control parameters. When these parameters are taken into account, an especially high quality uniform winding results.

A portion of the calender is preferably controllable in a zone-by-zone manner. The control device controls the zones in different ways depending upon parameters from the partial webs or the partial-web rolls. By taking into account the individually controllable zones, an optimum winding quality can be achieved for each individual partial web.

When a vertical roller stack is used, the additional influencing of the calender functions is preferably carried out primarily in the region of the lowest roller nip. Influencing is preferably carried out near the lowest roller nip because the greatest effect is achieved close to the calender exit. Additionally, thickness corrections, which are especially critical for the quality of the winding, can be carried out most easily at the lowest roller nip because the highest compressive stress prevails in this location.

If the calender includes a take-off device, placed upstream of the roller nips, the calender works in an "off-line" mode. The present invention is especially suitable to work in an off-line mode because, before the web of material enters the first roller nip, the web of material has already been subjected to one take-up procedure and one take-off procedure.

The calender preferably includes an automatic web draw-in device, which permits an automatic changing of the rollers at the entry to the calender. One such device is known by the name "Flying Splice".

Each winding station is preferably provided with an automatic winding tube changer. In an automatic winding tube changer, whenever a partial roll has reached its maximum diameter, a new winding tube is automatically fed into the winding station, so that the new partial roll can be built up without any interruption of the calender operation.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIBED OF THE PREFERRED EMBODIMENT

Figure 1:
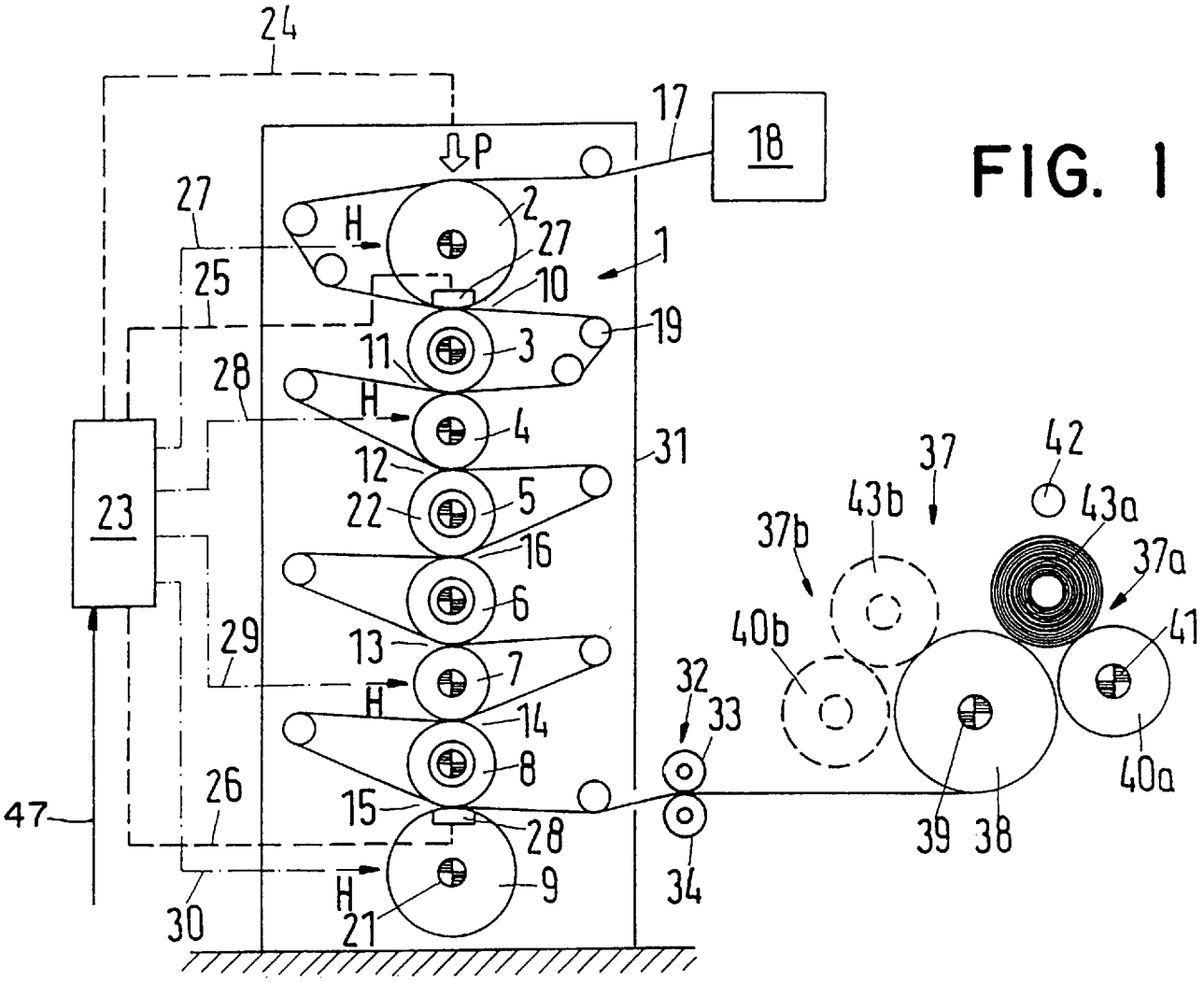
FIG. 1 is a schematic plan view of a calender in accordance with the present invention.
Figure 2:
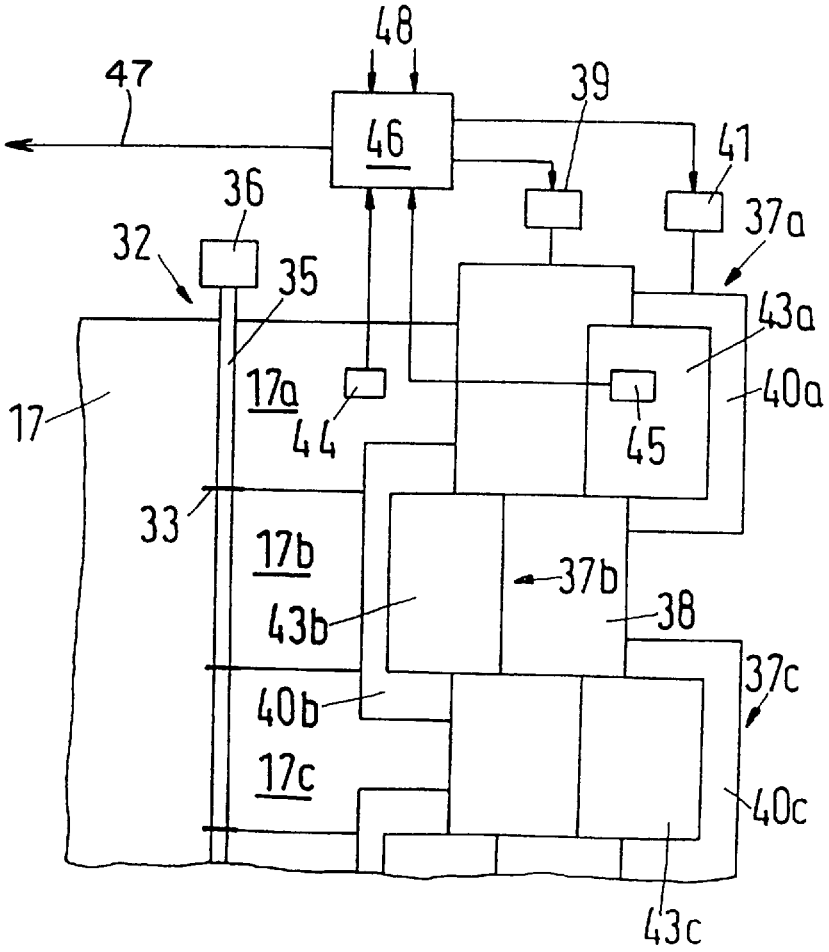
FIG. 2 is a schematic top view of the roller slitting and take-up region of the calender according to the present invention.

Referring now to FIG. 1, a roller stack 1 is illustrated. Roller stack 1 is preferably comprised of eight rollers, namely, a heatable, deflection-controllable hard upper roller 2, a soft roller 3, a heatable hard roller 4, a soft roller 5, a soft roller 6, a heatable hard roller 7, a soft roller 8 and a heatable, deflection-controllable hard lower roller 9. Thus, there are six working nips 10–15, each of which is defined by the juncture of one hard roller and one soft roller 2,3; 3,4; 4,5; 6,7; 7,8; and 8,9, respectively. In addition, a changeover nip 16 is defined by the juncture of two soft rollers 5 and 6.

A web of material 17 (e.g., paper) is fed from a take-off device 18 into the roller stack 1. Web 17 is guided through working nips 10–12, changeover nip 16 and working nips 13–15 by guide rollers 19. Upon exiting from the last working nip 15, web 17 is taken up in a winding device 37. A take-off device 18 is shown diagrammatically because it is a conventional "flying splice" system, which is known to those skilled in the art. In the three upper working nips 10–12, one side of web 17 lies against the hard rollers, while in the three lower working nips 13–15, the other side of the web lies against the hard rollers. Therefore, the desired surface structure, for example, gloss and/or smoothness, is achieved on both sides of the web of paper.

At least one of the rollers 2–9 has its own driving device 21. In many cases, however, it is preferably to provide all of the rollers with an independent driving device, for example, if an automatic drawing-in of the web of paper is desired at any particular roller.

A control device 23 is operatively connected to the roller stack 1 and has several functions. For example, by control line 24, the force P, with which the upper roller 2 is pressed downwardly, is regulated. In such an embodiment, the lower roller 9 is preferably held in a fixed position. However, the loading can also be carried out in the reverse direction, in which case the force P acts upwardly upon the lower roller 9 and the upper roller 2 is supported in a fixed manner. The amount of loading is used to determine the compressive stress that prevails in the individual working nips 10–15. This compressive stress increases from the top working nip to the bottom working nip, due to the fact that effective weight of each of the individual rollers disposed above the respective working nip must be added to the load force P.

By control lines 25 and 26, the fluid pressure applied to deflection controllable devices 27 and 28, for balancing the deflection of the upper roller 2 and the lower roller 9, respectively, is regulated. Devices 27, 28 ensure that a uniform compressive stress is applied over the entire axial length of the rollers. Deflection controllable devices 27, 28 are known to those skilled in the art and any conventional deflection devices can be used in the present invention. However, it is preferred that deflection controllable devices have support elements that are disposed alongside each other in a row. The support elements can preferably be deflected by different fluid pressures, either individually or in zones.

The hard rollers 2, 4, 7 and 9 are preferably heatable, as is indicated by arrows H. The heating energy is supplied to rollers 2, 4, 7, 9 by means of control paths 27–30, respectively, which are indicated by dash-dot-dash lines. The heating can be carried out by a heat transfer medium, or by electrical heating, radiant heating, etc. A protective cover 31 is used to aid in thermally insulating the roller stack 1. Cover 31 ensures that heat is passed to the surrounding area only to a relatively small extent. Additional calender functions, such as applying moisture to the web or varying the web speed and thus the length of time that the web spends in the roller nips (i.e., dwell time), can also be controlled by control device 23.

A longitudinal cutter 32 is disposed between the lowest working nip 15 and the take-up device 37. Cutter 32 has rotating cutting blades 33 and 34 which are driven by a common motor 36. After exiting roller nip 15, the web of paper 17 passes through the longitudinal cutter 32. Thus, the web of paper 17, which can, by way of example, have a width of 8 or 10 meters, is divided into individual partial webs 17*a*, 17*b*, 17*c* . . . .

Take-up device 37 includes a number of winding stations 37*a*, 37*b*, 37*c* . . . , which corresponds to the number of partial webs 17*a*, 17*b*, 17*c* . . . . A central roller 38 is common to all of the winding stations. Central roller 38 has a drive device 39. In addition, each winding station has a support roller 40*a*, 40*b*, 40*c*, . . . , each of which is provided with its own drive device 41. When a winding tube 42 is lowered from above into the nip between the central roller 38 and support roller 40*a* and is set into rotation by the rotating surfaces of the two rollers, winding tube 42 picks up partial web 17*a* and forms a partial-web roll 43*a*. Similarly, partial-web rolls 43*b*, 43*c*, . . . are formed in winding stations 37*b*, 37*c* . . . .

A measuring device 44 is disposed adjacent to each partial web 17*a*, 17*b*, 17*c* . . . to measure the tensile stress of the partial web. Additionally, a measuring device 45 is disposed adjacent to each partial-web roll 43*a*, 43*b*, 43*c* . . . to measure the roll diameter. The measured values of both the tensile stress and the roll diameter are processed in a second control device 46. In response to the measured values, second control device 46 adjusts the rotational speed of driving means 39 so that the circumferential speed of the central roller 38 is approximately the same as the web speed in the calender. Additionally, control device 46 adjusts the rotational speed of the individual driving means 41 for the support roller 40*a*, 40*b*, 40*c* . . . to make the necessary corrections for each partial-web roll 43*a*, 43*b*, 43*c* . . . . If the circumferential speed of the support roller 40*a* is greater than that of the central roller 38, a harder winding results, and if it is less, a softer winding results.

Control device 46 is also connected with the control device 23 by means of a signal path 47. Additionally, inputs 48 can also be sent to control device 46. These inputs 48 can represent data that are important for the winding process, for example, the thickness of the web of material or its dampness. On the basis of the information that is fed to the control devices 23 and 46, control device 23 is able to influence the calender function in such a way that the web of paper 17, exiting the last roller nip 15, matches, as close as possible, to the optimum winding conditions. As a result, little or no intervention is necessary in the area of the take-up device 37. In many cases, one can therefore dispense with individual control of the support rollers 40*a*, 40*b*, 40*c* . . . , and provide continuous support rollers. Particularly where the influencing of the web of paper 17 in the calender can be achieved on a zone-by-zone basis, it is possible to maintain the partial webs 17*a*, 17*b*, 17*c* . . . so uniformly that the same take-up drive can be used for all of the partial webs.

Having described the presently preferred exemplary embodiment of a calender in accordance with the present invention, it is believed that other modifications, variations and changes win be suggested to those skilled in the art in view of the teachings set forth herein. For example, it is possible to use take-up devices in which the winding tube is supported on bearings and is driven. It is also possible to use the calender in an in-line operation. It is, therefore, to be understood that all such modifications, variations, and changes are believed to fall within the scope of the present invention as defined by the appended claims.

What is claimed is:

1. A calender for treating a web of material comprising:

at least two rollers forming a roller nip therebetween;

a take-up device disposed downstream from said at least two rollers; and at least one longitudinal cutter disposed between said at least two rollers and said take-up device, said at least one longitudinal cutter having means for dividing the web of material into at least two partial webs, said take-up device having at least two winding stations, each of said winding stations corresponding to one of said partial webs, each of said winding stations having a drive device and a partial web roll, said drive devices being controlled by a control device which maintains the circumferential speed of said respective partial web roll at approximately the same speed as the web of material through said at least two rollers, said control device controls the circumferential speed of each partial web roll individually.

2. The calender according to claim 1, wherein the circumferential speed of said partial web roll is controlled in accordance with the properties of the partial webs.

3. The calender according to claim 2, further comprising a second control device to control the calender functions in a zone-by-zone manner, said calender functions including at least one of a compressive stress in said roller nip, a dwell time of the web of material in said roller nip, a temperature of the web of material, and a moisture of the web of material, said second control device being dependent on properties of at least one of said finished web, said partial webs and said partial web rolls.

4. The calender according to claim 3, further comprising measuring devices disposed adjacent to at least one of said partial webs and said partial-web rolls to measure properties of the web of material including one of the tensile stress of the partial webs and the partial web roll diameter.

5. The calender according to claim 4, wherein said second control device selectively controls the zones in accordance with properties measured from said measuring devices.

6. The calender according to claim 5, wherein said at least two rollers is comprised of at least three rollers which form a vertical roller stack, said second control device regulates said vertical roller stack primarily in the region of the lowest roller nip.

7. The calender according to claim 1, further comprising a take-off device disposed upstream of said at least two rollers.

8. The calender according to claim 1, further comprising an automatic web draw-in device.

9. The calender according to claim 1, wherein each winding station includes an automatic winding tube changer.

10. A calender for treating a web of material comprising:

at least two rollers forming a roller nip therebetween;

a take-up device disposed downstream from said at least two rollers;

at least one longitudinal cutter disposed between said at least two rollers and said take-up device, said at least one longitudinal cutter having means for dividing the web of material into at least two partial webs, said take-up device having at least two winding stations, each of said winding stations corresponding to one of said partial webs; and a control device to control the calender functions in a zone-by-zone manner, said calender functions including at least one of a compressive stress in said roller nip, a dwell time of the web of material in said roller nip, a temperature of the web of material, and a moisture of the web of material, said control device being dependent on properties of at least one of said partial webs and said partial web rolls.

11. The calender according to claim 10, further comprising measuring devices disposed adjacent to at least one of said partial webs and said partial-web rolls to measure properties of the web of material including one of the tensile stress of the partial webs and the partial web roll diameter.

12. The calender according to claim 11, wherein said at least two rollers are comprised of at least three rollers which form a vertical roller stack, and said control device regulates said vertical roller stack primarily in the region of the lowest roller nip.

13. The calender according to claim 12, wherein each of said winding stations has a drive device and a partial web roll, said drive devices being controlled by a second control device which maintains the circumferential speed of said respective partial web roll at approximately the same speed as the web of material through said at least two rollers, and the second control device individually controls the circumferential speed of each partial web roll.

14. The calender according to claim 13, wherein the circumferential speed of said partial web roll is controlled in accordance with the properties of the partial webs.

15. The calender according to claim 14, further comprising a take-off device disposed upstream of said at least two rollers.

16. The calender according to claim 15, further comprising an automatic web draw-in device.

17. The calender according to claim 16, wherein each winding station includes an automatic winding tube changer.

18. The calender according to claim 10, wherein said at least two rollers are comprised of at least three rollers which form a vertical roller stack, and said control device regulates said vertical roller stack primarily in the region of the lowest roller nip.

19. The calender according to claim 18, wherein each of said winding stations has a drive device and a partial web roll, said drive devices being controlled by a second control device which maintains the circumferential speed of said respective partial web roll at approximately the same speed as the web of material through said at least two rollers, and the second control device individually controls the circumferential speed of each partial web roll.

20. The calender according to claim 19, wherein the circumferential speed of said partial web roll is controlled in accordance with the properties of the partial webs.

21. The calender according to claim 20, further comprising a take-off device disposed upstream of said at least two rollers.

22. The calender according to claim 21, further comprising an automatic web draw-in device.

23. The calender according to claim 22, wherein each winding station includes an automatic winding tube changer.

* * * * *